US009816512B2

(12) United States Patent
Smith et al.

(10) Patent No.: US 9,816,512 B2
(45) Date of Patent: Nov. 14, 2017

(54) SEPARATED OPPOSED FLOW SINGLE COUPLING COMPRESSOR STAGE

(71) Applicant: BorgWarner Inc., Auburn Hills, MI (US)

(72) Inventors: Andrew Smith, Huddersfield (GB); Andrew Day, Huddersfield (GB); Simon Jennings, Pontefract (GB); Matthew Nicholson, Bradford (GB)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 14/800,282

(22) Filed: Jul. 15, 2015

(65) Prior Publication Data

US 2017/0016455 A1 Jan. 19, 2017

(51) Int. Cl.

| | |
|---|---|
| ***F04D 17/16*** | (2006.01) |
| ***F04D 29/42*** | (2006.01) |
| ***F04D 29/44*** | (2006.01) |
| ***F04D 17/10*** | (2006.01) |
| ***F04D 25/02*** | (2006.01) |

(52) U.S. Cl.

CPC ..... *F04D 17/10* (2013.01); *F04D 25/024* (2013.01); *F04D 29/4253* (2013.01)

(58) Field of Classification Search

CPC ..... F04D 17/10; F04D 29/40; F04D 29/4206; F04D 29/4253; F04D 29/441; F04D 29/42; F04D 29/44; F04D 29/403; F04D 17/165

USPC ..... 415/204

See application file for complete search history.

(56) References Cited

U.S. PATENT DOCUMENTS

| | | | | |
|---|---|---|---|---|
| 3,093,084 | A * | 6/1963 | Derderian | F04D 13/043 415/175 |
| 3,651,636 | A * | 3/1972 | Glassey | F02B 33/446 60/611 |
| 4,616,794 | A * | 10/1986 | King | 24/514 |
| 5,224,817 | A * | 7/1993 | Girault | F02K 9/48 415/111 |
| 5,232,333 | A * | 8/1993 | Girault | F02K 9/48 415/111 |
| 6,062,028 | A * | 5/2000 | Arnold | F02C 6/12 417/407 |
| 6,430,917 | B1 * | 8/2002 | Platts | F01D 5/022 60/39.43 |
| 7,044,718 | B1 * | 5/2006 | Platts | F02C 3/045 415/206 |
| 7,083,379 | B2 * | 8/2006 | Nikpour | F04D 27/0246 415/144 |
| 7,600,961 | B2 * | 10/2009 | Abdallah | F04D 17/12 415/1 |
| 2007/0065317 | A1 * | 3/2007 | Stock | F04D 25/06 417/423.11 |

(Continued)

*Primary Examiner* — Sean J Younger

(74) *Attorney, Agent, or Firm* — BrooksGroup

(57) ABSTRACT

A product usable with a turbocharger may include a compressor wheel having an inducer section and an exducer section. Air may be collected by the inducer section and expelled by the exducer section. A cover may define a diffuser and a collection volute. The diffuser may lead away from the exducer section to the collection volute. The cover may define a collection cavity opening to the collection volute through a port and extending in an axial direction. The cover may define an inlet passage around the inducer section and the cover may include a dividing wall separating the inlet passage from the collection cavity.

11 Claims, 3 Drawing Sheets

(56) References Cited

U.S. PATENT DOCUMENTS

2008/0078212 A1* 4/2008 Tsui ..... D06B 3/28
68/5 R

* cited by examiner

SEPARATED OPPOSED FLOW SINGLE COUPLING COMPRESSOR STAGE

TECHNICAL FIELD

The field to which the disclosure generally relates to includes turbochargers and more particularly includes turbochargers with a driven compressor stage connected with an associated engine's breathing system.

BACKGROUND

Turbochargers for use with internal combustion engines may be used to compress or charge air supplied to the engine's intake system. Turbochargers may include a turbine stage associated with the engine's exhaust manifold, a compressor stage associated with the engine's intake manifold, and a center housing positioned between the turbine and compressor stage. A turbine wheel in the turbine housing may be driven by an inflow of exhaust gas supplied from the exhaust manifold and may drive a connected impeller in the compressor stage. As an impeller rotates, it may increase air mass flow rate, airflow density and air pressure delivered to the engine's cylinders via the intake manifold.

SUMMARY OF ILLUSTRATIVE VARIATIONS

According to a number of illustrative variations, a product usable with a turbocharger may include a compressor wheel having an inducer section and an exducer section. Air may be collected by the inducer section and expelled by the exducer section. A cover may define a diffuser and a collection volute. The diffuser may lead away from the exducer section to the collection volute. The cover may define a collection cavity opening to the collection volute through a port and extending in an axial direction. The cover may define an inlet passage around the inducer section and the cover may include a dividing wall separating the inlet passage from the collection cavity.

Other illustrative variations within the scope of the invention will become apparent from the detailed description provided hereinafter. It should be understood that the detailed description and specific examples, while disclosing variations within the scope of the invention, are intended for purposes of illustration only and are not intended to limit the scope of the invention.

BRIEF DESCRIPTION OF THE DRAWINGS

Select examples of variations within the scope of the invention will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the scope of the invention, its application, or uses.

Figure 1:
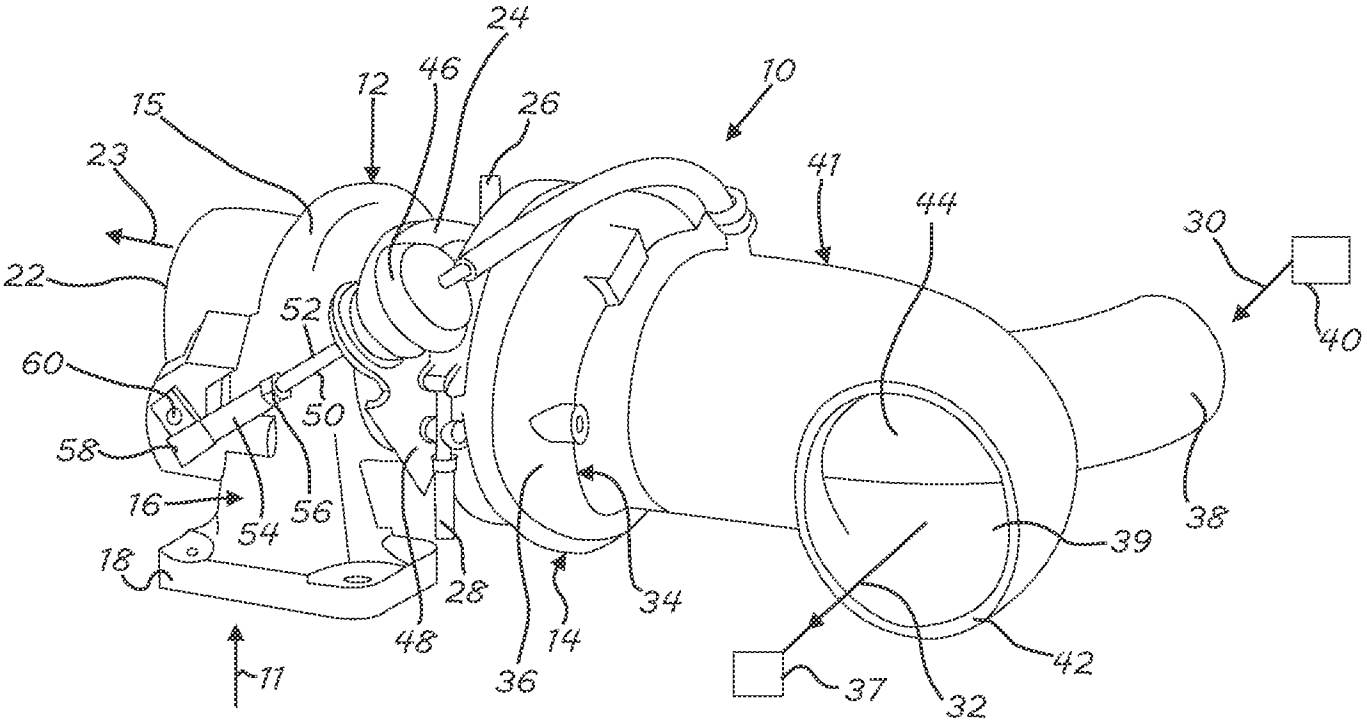
FIG. 1 is a perspective view of a turbocharger assembly according to a number of variations.

In a number of variations as illustrated in FIG. 1, a product 10, which may be used with a turbocharger system for an internal combustion engine, may include a turbine 12, and a compressor 14. The turbine 12 may include a turbine wheel that may exist in a continuous high velocity jet of incoming exhaust gases 11 entering through a volute 15 when the associated engine is running. The volute 15 may be defined by a turbine housing 16, which may include a flange 18 configured to connect with the exhaust outlet from the engine. The turbine housing 16 may also include an outlet 22 to direct outgoing exhaust gases 23 to an exhaust system.

A center housing 24 may be connected between the turbine 12 and the compressor 14. A shaft may extend through the center housing 24 and may connect the turbine's wheel with the compressor's wheel. One band clamp 26 may be used to secure the center housing 24 to the turbine housing 16, and another band clamp 28 may be used to secure the center housing 24 to the compressor 14.

In a number of variations the compressor 14 may draw in intake air 30 and expel charge air 32 at increased pressure and density. The compressor 14 may include a cover 34 with a collection volute 36 that may collect air from the compressor wheel which may be routed through a conduit 39 for delivery to the intake system of the associated engine 37 as charge air 32. Intake air 30 may be channeled through an intake conduit 38 which may extend from an air filter 40 through which ambient air may be drawn and which may be mixed with recirculated exhaust gases. The conduit 38 may extend through the wall 42 of outlet conduit 39 and may include a segment 44 that is entirely within the conduit 39. The conduits 38 and 39 may be integrally formed as an inlet and outlet unit 41, which may be connected to the compressor cover 34.

An actuator 46 may be mounted near the compressor 14, on a bracket 48. The bracket 48 may be connected to the center housing 24 or to the compressor housing 14. An arm 50 may extend from the actuator 46 toward the turbine 12. The arm 50 may include a first segment 52 and a second segment 54, with its length adjustable with a nut 56. The arm 50 may include an end 58 connected to rotate a shaft 60 on the turbine 12 when the arm 52 may be translated by the actuator 46. The shaft 60 may extend into the turbine 12 and may be connected to the valve plate to control diversion of exhaust gases.

Figure 2:
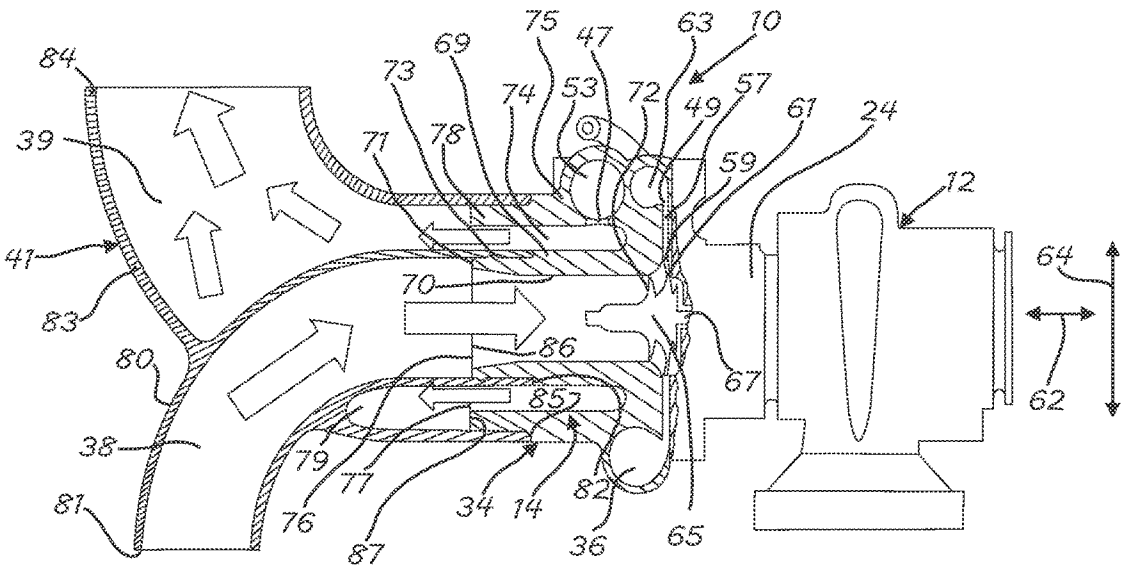
FIG. 2 is a cross sectioned illustration of the compressor stage area of a turbocharger according to a number of variations.

In the description associated with FIG. 2, elements may be described in relation to the direction in which parts extend. In this regard, reference number 62 indicates a line that extends in the axial direction, which coincides with left and right in the view of FIG. 2. The line indicating the axial direction 62 is shown coinciding with a central axis of the product 10. An axial extending part will extend on a line parallel to the central axis. Reference numeral 64 indicates a line that extends in the radial direction, which means toward or away from the central axis, and generally perpendicular thereto. A part that extends in the radial direction 64, may extend vertically as viewed in FIG. 2, as well as into or out of the page, or at various other orientations perpendicular to and through the central axis.

As shown in FIG. 2, in a number of variations the compressor 14 may include a compressor wheel 65 disposed on a shaft 67, which may be supported for rotation by the center housing 24 and may be connected to and driven by the turbine 12. The compressor cover 34 may include an annular dividing wall 69 that extends in the axial direction 62 and that defines an inlet passage 70 that leads to the inducer section 72 of the compressor wheel 65. The compressor cover 34 and the dividing wall 69 may include a terminal edge 71 on a side opposite the center housing 24, which may include a flange 73 extending outward away from the central axis in the radial direction. The dividing wall 69 may separate the inlet passage 70 from a collection cavity 74. The collection cavity may be formed as an annular shaped void that extends around the dividing wall 69 and may be open through the terminal edge 71. An outer wall 78 may be formed around, and spaced apart from the diving wall 69 to close the outer periphery of the collection cavity 74. Accordingly, the compressor cover 34 includes an axially extending section 75 that, at the terminal edge 71 presents circular shaped opening 76 to the inlet passage 70 and an annular shaped opening 77 to the collection cavity 74.

The compressor cover 34, in combination with the center housing 24 may define a diffuser 57 that may provide a collection port 59 facing the exducer section 61 of the compressor for air outflow. The diffuser 57 may extend radially outward around the compressor wheel 65 and may open to the collection volute 36. The collection volute 36, three cross sections of which are visible in FIG. 2, extends more than 360 degrees around the compressor wheel 65, and includes a segment 63 that registers with the diffuser 57 at a port 49 and a segment 53 that registers with the collection cavity 74 at a port 47.

The inlet and outlet unit 41 includes the inlet conduit 38 and the outlet conduit 39, and a chamber 79 which may form a part of the collection cavity 74 and may be open to the outlet conduit 39. The inlet conduit 38 may be defined by a conduit wall 80 formed as a continuous duct with a substantially circular open cross section. The conduit wall 80 may extend from a distal end 81 to a proximal end 82 and may curve over approximately ninety degrees there between. A segment of the conduit wall 80 adjacent the proximal end 82 may be positioned over and against the dividing wall 69 and may clip or otherwise be secured on the flange 73. The conduit wall 80 may cut through or transect the conduit wall 83 of the outlet conduit 39 and may divide the inlet conduit 38 within, and coaxial with, the outlet conduit 39 adjacent the proximal end 82. The conduit wall 83 may extend from a distal end 84 to a proximal end 85 and may curve over approximately ninety degrees there between. A segment of the conduit wall 83 adjacent the proximal end 85 may be positioned over and against the outside of the outer wall 78 and may clip or otherwise be secured thereon such as through a band clamp or other fastener. As a result, the distal end 81 and the distal end 84 are directed 180 degrees away from one another for connection to an air intake and exhaust system, respectively. The proximal end 82 may define a circular opening 86 that aligns with the opening 76 registering the intake conduit 38 with the inlet passage 70, and the proximal end 85 may define an annular opening 87 that aligns with the opening 77 registering the outlet conduit 39 with the collection cavity 74. The diameter of the conduit wall 83 may be larger at the proximal end 85 than at the distal end 84 to accommodate the annular opening 87 which may be defined around the circular opening 86. The conduit walls 80 and 83 may be cast or otherwise made as one piece to form the inlet and outlet unit 41

As a result, air entering through the inlet conduit 38 and inlet passage 70 may be collected by the inducer section 72 of the compressor wheel 65 and may be discharged by the exducer section 61 through the diffuser 57, collection volute 36, collection cavity 74, and outlet conduit 39. Air inflow and outflow are concentric and in opposite directions at the terminal edge 71. The circular shape of the opening 86 and the annular shape of the opening 87 mean that the connection between the inlet and outlet unit 41 and the compressor cover 34 may be made at any angular orientation. In addition, the inlet and outlet unit may be pre-piped into an assembled engine application and the compressor 14 and turbine 12 assembly may be connected through a single compressor piping connection by joining the inlet and outlet unit 41 with the compressor cover 34.

Figure 3:
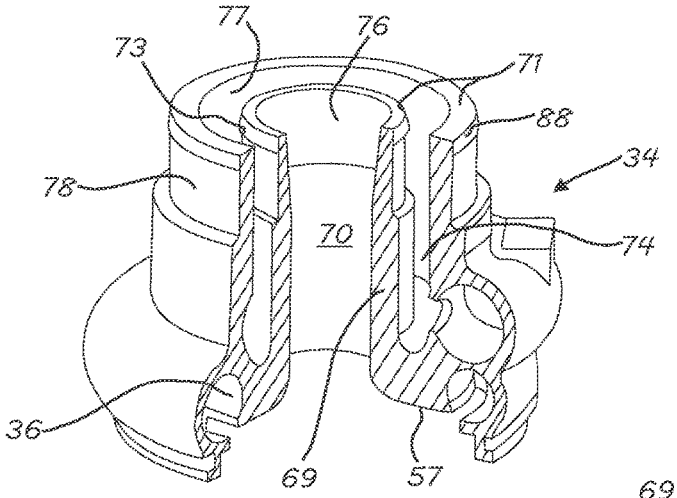
FIG. 3 is a perspective illustration of a sectioned compressor cover according to a number of variations.
Figure 4:
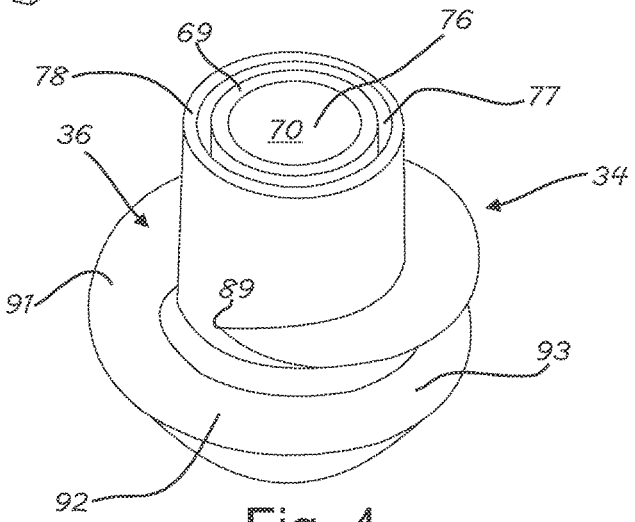
FIG. 4 is a perspective illustration of the compressor cover of FIG. 3 according to a number of variations.

Referring to FIGS. 3 and 4, in a number of variations the compressor cover 34 is shown in a sectioned perspective view and a perspective view un-sectioned. The compressor cover 34 may include the annular dividing wall 69 with the terminal edge 71 and which may include the flange 73. The dividing wall 69 may separate the inlet passage 70 from the collection cavity 74. The outer wall 78 may be formed around, and spaced apart from the diving wall 69 to close the outer periphery of the collection cavity 74. The outer wall 78 may also include a radially outward extending flange 88 for connection to the outlet conduit wall 83. The circular shaped opening 76 to the inlet passage 70 and the concentric annular shaped opening 77 to the collection cavity 74 are readily seen, along with the collection volute 36, which registers with the diffuser 57 and the collection cavity 74. As shown in FIG. 4, the collection volute 36 includes a segment 91 that extends 360 degrees around the compressor cover 34 from an initiation point 89 to a point 92 and includes an additional segment 93 that extends a further angular distance around the compressor cover 34 from the point 92. The segment 91, or a portion thereof, may register with the diffuser 57 and the segment 93, or a portion thereof, may register with the collection cavity 74.

Figure 5:
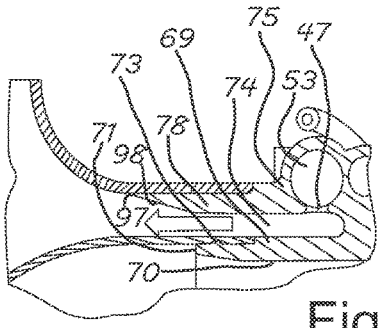
FIG. 5 is a fragmentary cross sectioned illustration of part of a compressor stage area of a turbocharger according to a number of variations.

With reference to FIG. 5, a number of variations may include an outer wall 78 that may have a blended diameter change that my form a tapered surface 98 from the edge 71 to an extended edge 97 of the outer wall 78. The compressor outlet transition from the collection cavity 74 with the tapered surface 98 facing the outlet flow may provide desirable flow characteristics. The outer wall 78 may extend to the edge 97 a distance beyond the dividing wall 69, which may extend to the edge 71.

The following description of variants is only illustrative of components, elements, acts, product and methods considered to be within the scope of the invention and are not in any way intended to limit such scope by what is specifically disclosed or not expressly set forth. The components, elements, acts, product and methods as described herein may be combined and rearranged other than as expressly described herein and still are considered to be within the scope of the invention.

Variation 1 may include a product usable with a turbocharger with a compressor wheel having an inducer section and an exducer section. Air may be collected by the inducer section and expelled by the exducer section. A cover may define a diffuser and a collection volute. The diffuser may lead away from the exducer section to the collection volute. The cover may define a collection cavity opening to the collection volute through a port and extending in an axial direction. The cover may define an inlet passage around the inducer section and the cover may include a dividing wall separating the inlet passage from the collection cavity.

Variation 2 may include the product according to variation 1 wherein the collection cavity may be annular in shape and may be concentric with the inlet passage.

Variation 3 may include the product according to variation 2 wherein the inlet passage may have a circular cross section.

Variation 4 may include the product according to any of variations 1 through 3 wherein the collection volute may extend around the cover for more than 360 angular degrees.

Variation 5 may include the product according to variation 4 wherein the collection volute may include a first segment that registers with the diffuser and a second segment that registers with the collection cavity.

Variation 6 may include the product according to variation 5 wherein the first segment may not register with the collection cavity and the second segment may not register with the diffuser.

Variation 7 may include the product according to any of variations 1 through 6 wherein the cover may include an outer wall that may extend around the dividing wall, and the outer wall and dividing wall in combination may define the collection cavity.

Variation 8 may include the product according to any of variations 1 through 7 and may include an inlet and outlet unit connected to the cover. An inlet conduit may be defined by a first conduit wall and an outlet conduit may be defined by a second conduit wall. The inlet conduit may extend through the second conduit wall.

Variation 9 may include the product according to variation 8 wherein the second conduit wall may include a proximate end having a first diameter at the cover and a distal end having a second diameter away from the cover. The first diameter may be larger than the second diameter.

Variation 10 may include a product for a turbocharger and may include a center housing. A compressor wheel may be rotatably supported by the center housing. A cover may be connected to the center housing and may cover the compressor wheel. The cover may define an inlet passage and a collection cavity. The inlet passage may lead to the compressor wheel and the collection cavity may receive a gas compressed by the compressor wheel. The cover may include a dividing wall dividing the inlet passage from the collection cavity and an outer wall extending around and spaced apart from the dividing wall to define the collection cavity. The collection cavity may be coaxially disposed around the inlet passage.

Variation 11 may include the product according to variation 10 wherein the cover may further define a diffuser and a collection volute. The diffuser may receive the gas compressed by the compressor wheel and may deliver the gas to the collection volute. The collection volute may deliver the gas to the collection cavity.

Variation 12 may include the product according to variation 10 or 11 wherein the collection cavity may be annular in shape and may be concentric with the inlet passage.

Variation 13 may include the product according to variation 11 wherein the collection volute may extend around the cover for more than 360 angular degrees.

Variation 14 may include the product according to variation 13 wherein the collection volute may include a first segment that may register with the diffuser and a second segment that may register with the collection cavity.

Variation 15 may include the product according to any of variations 10 through 14 and may include an inlet and outlet unit connected to the cover. An inlet conduit may be defined by a first conduit wall and an outlet conduit may be defined by a second conduit wall. The inlet conduit may extend through the second conduit wall.

Variation 16 may include the product according to variation 15 wherein the second conduit wall may include a proximate end that may have a first diameter at the cover and a distal end that may have a second diameter away from the cover, and wherein the first diameter may be larger than the second diameter.

Variation 17 may include a turbocharger assembly that may include a turbine, a compressor wheel, and a shaft connecting the compressor wheel with the turbine so that the compressor wheel may be driven by the turbine. A center housing may support the shaft. A cover may be connected to the center housing. The cover may define an inlet passage, a diffuser, a collection volute, and a collection cavity. The inlet passage may lead to the compressor wheel. A gas compressed by the compressor wheel may be delivered to the diffuser and there through to the collection volute. The collection cavity may receive the compressed gas from the collection volute. The collection cavity may be annular in shape and may be defined coaxially with the inlet passage.

Variation 18 may include the product according to variation 17 wherein the collection volute may extend around the cover for more than 360 angular degrees.

Variation 19 may include the product according to variation 17 or 18 wherein the collection volute may include a first segment that may register with the diffuser and a second segment that may register with the collection cavity.

Variation 20 may include the product according to any of variations 17 through 19 and may include an inlet and outlet unit connected to the cover. An inlet conduit may be defined by a first conduit wall and an outlet conduit may be defined by a second conduit wall. The inlet conduit may extend through the second conduit wall.

The above description of select variations within the scope of the invention is merely illustrative in nature and, thus, variations or variants thereof are not to be regarded as a departure from the spirit and scope of the invention.

What is claimed is:

1. A product able to be used with a turbocharger comprising a compressor wheel having an inducer section and an exducer section wherein air is collected by the inducer section and expelled by the exducer section; a cover defining a diffuser and a collection volute, the diffuser leading away from the exducer section to the collection volute, the cover defining a collection cavity opening to the collection volute through a port and extending in an axial direction, the cover defining an inlet passage around the inducer section and the cover including a dividing wall separating the inlet passage from the collection cavity, wherein the collection volute extends around the cover for more than 360 angular degrees.

2. The product according to claim 1 wherein the collection volute includes a first segment that registers with the diffuser and a second segment that registers with the collection cavity.

3. The product according to claim 2 wherein the first segment does not register with the collection cavity and the second segment does not register with the diffuser.

4. A product for a turbocharger comprising a center housing; a compressor wheel rotatably supported by the center housing; and a cover connected to the center housing and covering the compressor wheel, the cover defining an inlet passage and a collection cavity, the inlet passage leading to the compressor wheel and the collection cavity receiving a gas compressed by the compressor wheel, wherein the cover includes a dividing wall dividing the inlet passage from the collection cavity and an outer wall extending around and spaced apart from the dividing wall to define the collection cavity, the collection cavity coaxially disposed around the inlet passage, and a first end of the collection cavity and a second end of the collection cavity, with a length of the collection cavity defined from the first end to the second end, wherein the dividing wall is completely disposed inside the collection cavity for the length in its entirety, and the inlet passage is defined against a first side of the dividing wall for the length in its entirety, and the collection cavity is defined against a second side of the dividing wall for the length in its entirety, wherein the cover further defines a diffuser and a collection volute, the diffuser receiving the gas compressed by the compressor wheel and delivering the gas to the collection volute, the collection volute delivering the gas to the collection cavity, wherein the collection volute extends around the cover for more than 360 angular degrees.

5. The product according to claim 4 wherein the collection cavity is annular in shape and is concentric with the inlet passage so that the gas flows to the compressor wheel through the inlet passage and inside the collection cavity in a first direction and wherein the gas is exhausted through the collection cavity in a second direction opposite the first direction.

6. The product according to claim 4 wherein the collection volute includes a first segment in a first 360 angular degrees that the collection volute extends and that registers with the diffuser and a second segment where the collection volute extends beyond the first 360 angular degrees and that registers with the collection cavity.

7. The product according to claim 4 further comprising an inlet and outlet unit connected to the cover, and including an inlet conduit defined by a first conduit wall, wherein the inlet conduit joins with the inlet passage, and an outlet conduit defined by a second conduit wall, wherein the outlet conduit joins with the collection cavity, and wherein the inlet conduit extends through the second conduit wall.

8. The product according to claim 7 wherein the second conduit wall includes a proximate end having a first diameter at the cover and a distal end having a second diameter away from the cover, and wherein the first diameter is larger than the second diameter.

9. A turbocharger assembly comprising a turbine; a compressor wheel; a shaft connecting the compressor wheel with the turbine so that the compressor wheel is driven by the turbine; a center housing supporting the shaft; a cover connected to the center housing, the cover defining an inlet passage, a diffuser, a collection volute, and a collection cavity, the collection volute has a first segment that registers with the diffuser and a second segment that does not register with the diffuser, the inlet passage leading to the compressor wheel, wherein a gas compressed by the compressor wheel is delivered from the compressor wheel to the diffuser and there through to the collection volute, a port registering with the second segment and providing an opening from the collection volute to the collection cavity, wherein the collection cavity receives the compressed gas from the collection volute, and wherein the collection cavity is annular in shape and is defined coaxially with the inlet passage, wherein the gas flows to the compressor wheel through the inlet passage and inside the collection cavity in a first direction and wherein the gas is exhausted from the compressor wheel through the collection cavity and around the inlet passage in a second direction opposite the first direction, wherein the collection volute extends around the cover for more than 360 angular degrees.

10. The product according to claim 9 further comprising an inlet and outlet unit connected to the cover, and including an inlet conduit defined by a first conduit wall and an outlet conduit defined by a second conduit wall, wherein the inlet conduit and the first conduit wall extend through the second conduit wall, wherein the inlet conduit joins with the inlet passage inside the outlet conduit.

11. The product according to claim 9 further comprising an axis extending through the shaft wherein the compressor wheel rotates about the axis, and wherein the inlet passage and collection cavity extend along the axis with the inlet passage defined inside the collection cavity.

* * * * *